US011584479B2

(12) United States Patent
Behrman et al.

(10) Patent No.: US 11,584,479 B2
(45) Date of Patent: Feb. 21, 2023

(54) VESSEL ATTACHMENT DEVICE

(71) Applicant: Superior-Lidgerwood-Mundy Corporation, Superior, WI (US)

(72) Inventors: Kenneth Leigh Behrman, Plymouth, MN (US); Grant Michael Feldhege, Rogers, MN (US)

(73) Assignee: SUPERIOR-LIDGERWOOD-MUNDY CORPORATION, Superior, WI (US)

( * ) Notice: Subject to any disclaimer, the term of this patent is extended or adjusted under 35 U.S.C. 154(b) by 171 days.

(21) Appl. No.: 17/201,031

(22) Filed: Mar. 15, 2021

(65) Prior Publication Data

US 2021/0291937 A1 Sep. 23, 2021

Related U.S. Application Data

(60) Provisional application No. 63/037,715, filed on Jun. 11, 2020, provisional application No. 62/991,114, filed on Mar. 18, 2020.

(51) Int. Cl.
*B63B 21/08* (2006.01)

(52) U.S. Cl.
CPC ..... *B63B 21/08* (2013.01)

(58) Field of Classification Search
CPC ... B63B 21/04; B63B 21/08; B63B 2021/001; B63B 2021/002; B63B 2021/003; B63B 2021/004
USPC ..... 114/381, 378, 343, 230.1, 230.18, 230.2, 114/230.28, 230.3
See application file for complete search history.

(56) References Cited

U.S. PATENT DOCUMENTS 5,123,374 A * 6/1992 McMillan ..... B63B 21/60 114/230.3
7,637,222 B1 * 12/2009 Keely ..... B63B 21/00 114/230.17

* cited by examiner

*Primary Examiner* — Daniel V Venne
(74) *Attorney, Agent, or Firm* — Fredrikson & Byron, P.A.

(57) ABSTRACT

A vessel attachment device includes a body, first and second attachment arms, a biasing member, and at least one line connection interface. At least one of the first attachment arm and the second attachment arm is movable relative to the body. The biasing member is configured to apply a biasing force at the at least one movable first and second attachment arm to bias the at least one movable first and second attachment arm to an open position. And, the biasing member is configured to selectively release the biasing force and apply an actuation force at the at least one movable first and second attachment arm to move the at least one movable first and second attachment arm from the open position to the closed position to attach the vessel attachment device to a vessel attachment point.

20 Claims, 11 Drawing Sheets

VESSEL ATTACHMENT DEVICE

RELATED APPLICATIONS

This application claims priority to, and the benefit of, U.S. provisional patent application No. 62/991,114, filed on Mar. 18, 2020, and U.S. provisional patent application No. 63/037,715, filed on Jun. 11, 2020.

TECHNICAL FIELD

This disclosure generally relates to vessel attachment devices, systems, and related methods. Embodiments are described herein in the context of vessel attachment devices, systems, and methods that facilitate a removable attachment to a vessel.

BACKGROUND

Vessels are used in a variety of applications to transport goods. In general, a vessel is loaded with goods at a first site, transported to a second site, and unloaded at the second site. In many such applications, a series of interconnected vessels, such as barges or train cars, are used to increase the capacity of goods being transported. Often times while loading/unloading the vessel, the vessel can be controllably moved relative to a loading/unloading point (e.g., conveyor, crane, etc.). For instance, in the case of barges, a line and associated winch attached to the barge may be used to controllably move the barge along a surface of a waterway relative to the loading/unloading point. This controllable movement of the barge can allow the barge to be more efficiently loaded/unloaded.

However, current practice generally requires human presence at the vessel to manually attach the line to, and remove the line from, the vessel. Given the various dynamic forces involved in many vessel loading/unloading applications, human presence at, or near, the vessel can be hazardous. For example, in the case of barges, a fall from the barge can be one primary hazard to the human present at the barge. Because many barge loading/unloading applications can occur at waterways with relatively strong currents, a fall from the barge can be particularly hazardous.

SUMMARY

In general, various embodiments relating to vessel attachment devices, systems, and methods are disclosed herein. In particular, disclosed herein are embodiments of a vessel attachment device that is configured to removably attach a line to a vessel. Such removable attachment to a vessel can be useful, for instance, in facilitating attachment of the line to the vessel via which the vessel can be controllably moved to a desired position for a particular operation (e.g., loading/unloading the vessel). The vessel attachment device's removable attachment to the vessel can then release the vessel from the line when the operation is complete. Exemplary vessels with which embodiments of the vessel attachment device can be used include barges, ships, and train cars.

Notably, various vessel attachment device embodiments can be useful, for instance, in removably attaching a line to, and subsequently releasing the line from, a vessel without requiring human presence at the vessel. Such vessel attachment device embodiments can both selectively attach to and selectively release from a vessel in an automated manner that eliminates the need to have a human presence at the vessel to manually attach the line to, and remove the line from, the vessel. Thus, vessel attachment device, system, and method embodiments disclosed herein can increase the safety and efficiency of a wide range of applications in which a vessel is removably attached to a line.

One embodiment includes a vessel attachment device. The vessel attachment device includes a body, a first attachment arm, a second attachment arm, a biasing member, and at least one line connection interface. The first attachment arm and the second attachment arm extend out from the body, and at least one of the first attachment arm and the second attachment arm is movable relative to the body. The biasing member applies a biasing force at the at least one movable first attachment arm and second attachment arm to bias the at least one movable first attachment arm and second attachment arm to an open position. The vessel attachment device is configured such that when an actuation force is applied at the at least one line connection interface, the biasing force at the at least one movable first attachment arm and second attachment arm is overcome and the at least one movable first attachment arm and second attachment arm is moved from the open position to a closed position to attach the vessel attachment device to a vessel attachment point.

Another embodiment of a vessel attachment device includes a body, a first attachment arm, a second attachment arm, a biasing member, and at least one line connection interface. The first attachment arm and the second attachment arm extend out from the body, and at least one of the first attachment arm and the second attachment arm is movable relative to the body. The biasing member applies a biasing force at the at least one movable first attachment arm and second attachment arm to bias the at least one movable first attachment arm and second attachment arm to an open position. The biasing member is configured to selectively release the biasing force and apply an actuation force at the at least one movable first attachment arm and second attachment arm to move the at least one movable first attachment arm and second attachment arm from the open position to a closed position to attach the vessel attachment device to a vessel attachment point.

In some such embodiments of this vessel attachment device, the biasing member can include an actuator and a force transfer mechanism. The actuator can generate the biasing force and the actuation force, and the force transfer mechanism can couple the actuator to the at least one movable first attachment arm and second attachment arm. In one embodiment, the force transfer mechanism is a linkage assembly. The linkage assembly can include a first link element that is at an over-centered position when the vessel attachment device is in the closed position. The over-centered position of the first link element can be configured to maintain the at least one movable first attachment arm and second attachment arm in the closed position. For example, the over-centered position of the first link element can be configured such that, for the at least one movable first attachment arm and second attachment arm to move from the closed position to the open position, the actuator needs to apply a second actuation force. The over-centered position of the first link element can be oriented such that forces imparted on the first link element, from vessel attachment device components other than the actuator, are transferred through the first link element without causing rotational movement of the first link element. In this way, the over-centered position of the first link element can be configured to resist rotational movement of the first link element, upon application of force from vessel attachment device components other than the actuator, and thereby maintain the at least one movable first attachment arm and second attachment arm in the closed position.

The details of one or more examples are set forth in the accompanying drawings and the description below. Other features, objects, and advantages will be apparent from the description and drawings.

BRIEF DESCRIPTION OF THE DRAWINGS

The following drawings are illustrative of particular embodiments of the present invention and, therefore, do not limit the scope of the invention. The drawings are intended for use in conjunction with the explanations in the following description. Embodiments of the invention will hereinafter be described in conjunction with the appended drawings, wherein like numerals denote like elements. The features illustrated in the drawings are not necessarily to scale, though embodiments within the scope of the present invention can include one or more of the illustrated features (e.g., each of the illustrated features) at the scale shown.

FIG. 2A is a side elevational view of the vessel attachment device approaching the vessel attachment point with a movable attachment arm biased to an open position. FIG. 2B is a side elevational view of the vessel attachment device positioned at, and attaching to, the vessel attachment point. FIG. 2C is a side elevational view of the vessel attachment device with the movable attachment arm moved to the closed position to attach the vessel attachment device to the vessel attachment point.

FIG. 5A is a side elevational view of the vessel attachment device approaching the vessel attachment point with a movable attachment arm biased to an open position. FIG. 5B is a side elevational view of the vessel attachment device positioned at, and attaching to, the vessel attachment point. FIG. 5C is a side elevational view of the vessel attachment device with the movable attachment arm moved to the closed position to attach the vessel attachment device to the vessel attachment point.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
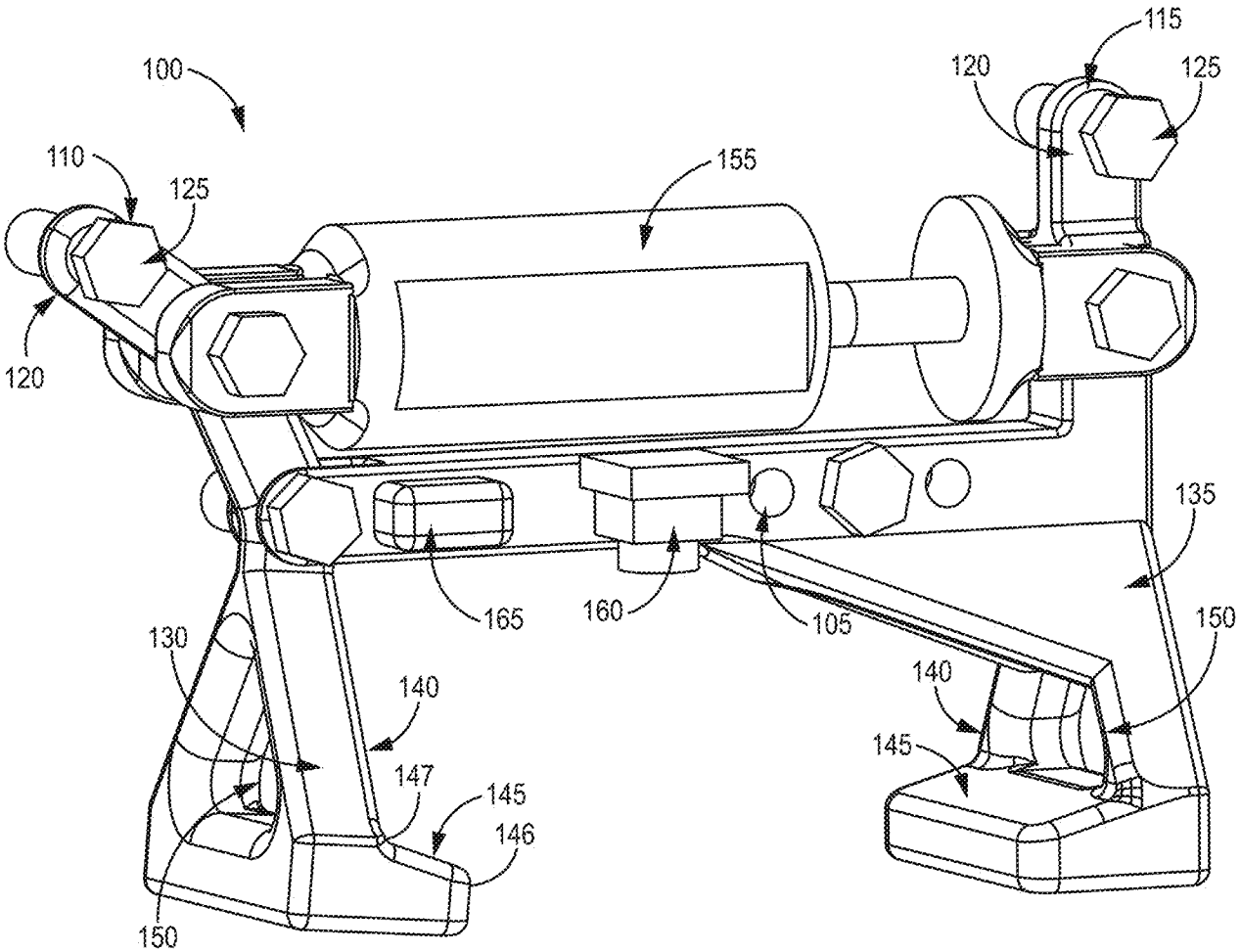
FIG. 1 is a perspective view of an embodiment of a vessel attachment device.

FIG. 1 shows a perspective view of an exemplary embodiment of a vessel attachment device 100. In operation, the vessel attachment device 100 can selectively attach a line to a vessel and remove the line from the vessel. The vessel attachment device 100 can be configured to both attach the line to, and remove the line from, the vessel without requiring human presence at the vessel. As such, the vessel attachment device 100 can both selectively attach to and selectively release from a vessel in an automated manner that eliminates the need to have a human present at the vessel to manually attach the line to the vessel.

The illustrated vessel attachment device 100 includes a body 105. The body 105 can include at least one line connection interface 110. The body 105 of the illustrated embodiment of the vessel attachment device 100 includes two line connection interfaces 110, 115. The line connection interfaces 110, 115 can be configured to connect to one or more lines. For example, the line connection interface 110 can be configured to connect to a first line and the line connection interface 115 can be configured to connect to a second line. Each line connection interface 110, 115 can include a connection member 120 that is complementary to a connection member at the respective line in a manner that is configured to interconnect to respective line and line connection interface 110, 115. In the illustrated embodiment, the connection member 120 of each line connection interface 110, 115 includes a socket-type connection member that is configured to receive a pin 125 therethrough to connect the line at the line connection interface 110, 115.

The vessel attachment device 100 also includes a first attachment arm 130 and a second attachment arm 135. Each of the first attachment arm 130 and the second attachment arm 135 extends out from the body 105. As will be described further below, at least one of the first attachment arm 130 and the second attachment arm 135 is movable relative to the body 105. In the illustrated embodiment of the vessel attachment device 100, the first attachment arm 130 is movable relative to the body 105 and the second attachment arm 135 is fixed relative to the body 105. Though in other vessel attachment device embodiments, both the first attachment arm 130 and the second attachment arm 135 can be movable relative to the body 105.

Each of the first attachment arm 130 and the second attachment arm 135 can be configured to contact, and attach to, a vessel attachment point. For example, each attachment arm 130, 135 can include a vessel attachment point interface portion 140 that is configured to contact, and attach to, the vessel attachment point. For example, each illustrated interface portion 140 includes a contact surface 145 and a holding structure 150. The contract surface 145 can be configured to contact the vessel attachment point and guide the vessel attachment point, relative to the attachment arms 130, 135, into an appropriate secured attachment position at the holding structure 150. In the illustrated embodiment, the contact surface 145 is sloped upward in a direction from an interior end portion 146 of the contact surface 145 opposite the holding structure 150 to an exterior end portion 147 of the contact surface 145 adjacent the holding structure 150. The holding structure 150 can define a retention structure complementary to the vessel attachment point and be configured to retain a portion of the vessel attachment point after it has passed over the contact surface 145. In the illustrated embodiment, the holding structure 150 defines an aperture through the respective attachment arm 130, 135 and adjacent to the exterior end portion 147 of the contact surface 145. Though, in other embodiments the holding structure 150 can define other retention structures as appropriate for retaining the particular geometric configuration of the vessel attachment point in a specific application.

The vessel attachment device 100 further includes a biasing member 155. The biasing member 155 can be configured to apply a biasing force on at least one of the first attachment arm 130 and the second attachment arm 135. The biasing member 155 can apply and release the biasing force via, for instance, a spring-loaded mechanism, a pneumatic mechanism, a hydraulic mechanism, an electronic mechanism, or a magnetic mechanism. As noted, at least one of the first attachment arm 130 and the second attachment arm 135 is movable relative to the body 105. The biasing member 155 can be configured to apply a biasing force on the at least one movable first attachment arm 130 and second attachment arm 135 to bias the at least one movable first attachment arm 130 and second attachment arm 135 to an open position. The open position can be configured to allow the vessel attachment point to be received at the vessel attachment device 100 (e.g., the attachment arms 130, 135 are further apart from each other in the open position than in the closed position). For example, in the illustrated embodiment of the vessel attachment device 100, the first attachment arm 130 is movable relative to the body 105 and the biasing member 155 applies a biasing force on the first attachment arm 130 to bias the first attachment arm 130 to the open position.

The vessel attachment device 100 can be configured to move the at least one movable first attachment arm 130 and second attachment arm 135 to a closed position. The closed position can be configured to attach the vessel attachment point to the vessel attachment device 100, for instance at the first attachment arm 130 and the second attachment arm 135. Here, in the closed position, the first and second attachment arms 130, 135 are closer together than in the open position. In particular, the vessel attachment device 100 can be configured such that when an actuation force is applied to at least one line connection interface 110, 115, the biasing force applied by the biasing member 155 on the at least one movable first attachment arm and second attachment arm 130, 135 is overcome. As a result, the at least one movable first attachment arm and second attachment arm 130, 135 is moved from the open position to the closed position to attach the first attachment arm 130 and the second attachment arm 135 to the vessel attachment point. In the illustrated embodiment, the vessel attachment device 100 can be configured to move the first attachment arm 130 from the open position to the closed position. More specifically, when an actuation force is applied at the line connection interface 110, the biasing force applied by the biasing member 155 on the first attachment arm 130 is overcome and the first attachment arm 130 is moved from the open position to the closed position to engage, and thereby attach the vessel attachment device 100 to, the vessel attachment point.

As noted, the exemplary embodiment of the vessel attachment device 100 shown here includes the first attachment arm 130 movable relative to the body 105 and the second attachment arm 135 fixed relative to the body 105. Such an embodiment may be useful in certain applications by providing increased control consistency in transitioning the vessel attachment device 100 between the open and closed positions at the vessel attachment point. Though in other embodiments, both of the first attachment arm 130 and the second attachment arm 135 can be movable relative to the body 105 (e.g., by applying an actuation force at each of the line connection interfaces 110, 115).

In various embodiments, the vessel attachment device 100 can include one or more additional features. For example, the illustrated embodiment of the vessel attachment device 100 includes a position feedback device 160. As shown here, the position feedback device 160 is generally centered along the body 105 between the first and second attachment arms 130, 135. The position feedback device 160 can be configured to relay information relating to the position of the vessel attachment device 100 relative to the vessel attachment point. This can be useful in providing information that allows for a determination as to when to transition the vessel attachment device 100 between the open and closed positions (e.g., when to apply the actuation force at the line connection interface to move the at least one movable attachment arm from the open to the closed position).

For instance, the position feedback device 160 can be a camera configured to capture image data corresponding to the position of the vessel attachment device 100 relative to the vessel attachment point. In one such example, the camera can include a wireless transmitter configured to wirelessly convey image data captured by the camera to a remote receiving device (e.g., remote monitoring/control device). When present, the wireless transmitter can also be configured to convey other data collected at other sensors present at the vessel attachment device 100. An operator at the remote receiving device can then utilize this image data to ascertain when to apply an actuation force to transition the vessel attachment device 100 from the open to the closed position. The operator may also use the image data to ascertain when the attachment device 100 has sufficient clearance relative to the vessel attachment point to allow the vessel to be moved relative to the vessel attachment device 100. Alternative or additional position feedback devices can be included in various embodiments.

In addition, in certain embodiments, the vessel attachment device 100 can include a locking mechanism 165. The locking mechanism can be configured to retain the at least one movable attachment arm 130, 135 in the closed position. For instance, in the illustrated embodiment with the movable first attachment arm 130, the locking mechanism 165 can be configured to retain the first attachment arm 130 in the closed position. Thus, in this illustrated embodiment, the movable first attachment arm 130 can be biased to the open position by the biasing member 155 and, when this bias force is overcome and the first attachment arm 130 is moved to the closed position, retained in the closed position by the locking mechanism 165. For example, the locking mechanism 165 can be triggered to retain the movable attachment arm 130 in the closed position when the movable attachment arm 130 is moved to a predetermined location relative to the body 105. The locking mechanism 165 can be, for example, an electronic locking mechanism or mechanical locking mechanism in connection with the movable attachment arm 130.

Also, in some embodiments, the vessel attachment device 100 can include a power source. For example, the vessel attachment device 100 can include one or more batteries as the power source, for instance at the body 105. As another example, the vessel attachment device 100 can include a hardwired power receptacle that is configured to receive a power line. As an additional example, the vessel attachment device 100 can include one or more solar panels as the power source, for instance at the body 105. The power source (e.g., one or more batteries) can be configured to supply electrical power to one or more components of the vessel attachment device 100, such as the biasing member 155 (depending on the type of biasing member 155), the position feedback device 160, and/or the locking mechanism 165.

In some applications, it may be useful to include one or more notification features at the vessel attachment device 100. Accordingly, some embodiments of the vessel attachment device 100 can include visual and/or audio output devices. For example, the vessel attachment device 100 can include one or more light output devices and/or one or more sound output devices. For instance, the light and/or sound output devices can be configured to output a respective visual or audio notification when a predefined condition is present at the vessel attachment device. This could include outputting a visual and/or audio notification when the vessel attachment device 100 is attached to the vessel attachment point and/or when the vessel attachment device is being released from the vessel attachment point.

Figure 2A:
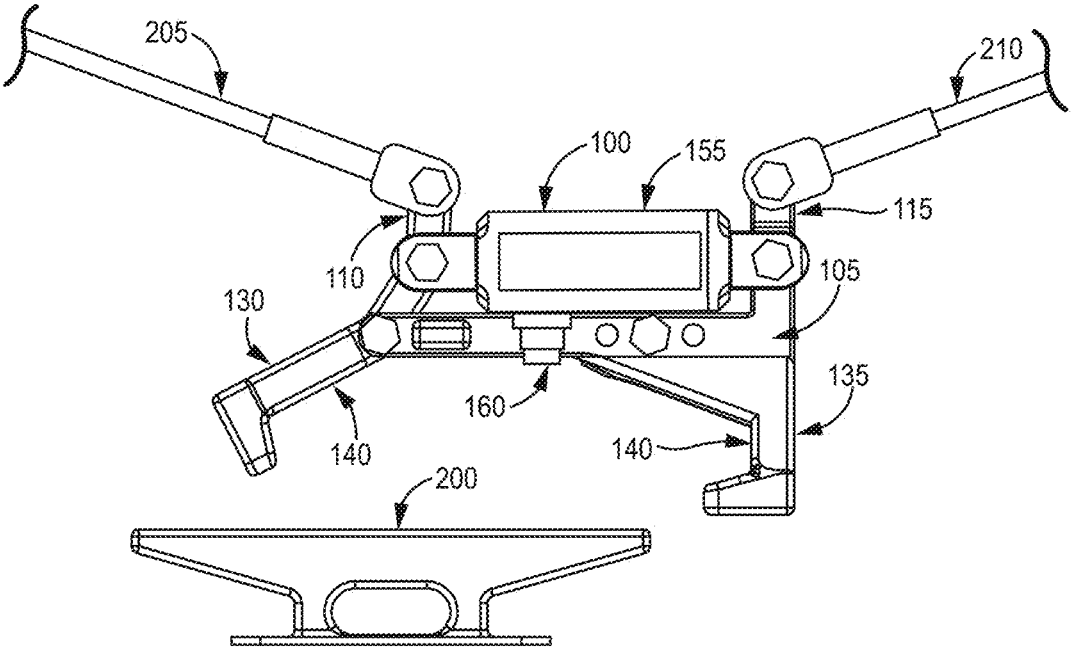
FIGS. 2A-2C show a sequence of attaching the vessel attachment device, of FIG. 1, to a vessel attachment point.
Figure 2B:
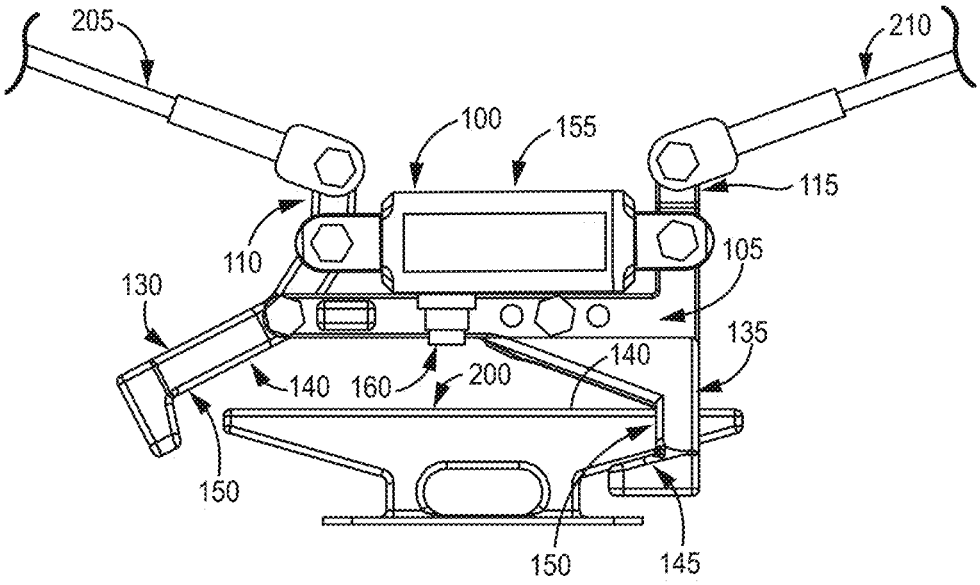
Figure 2C:
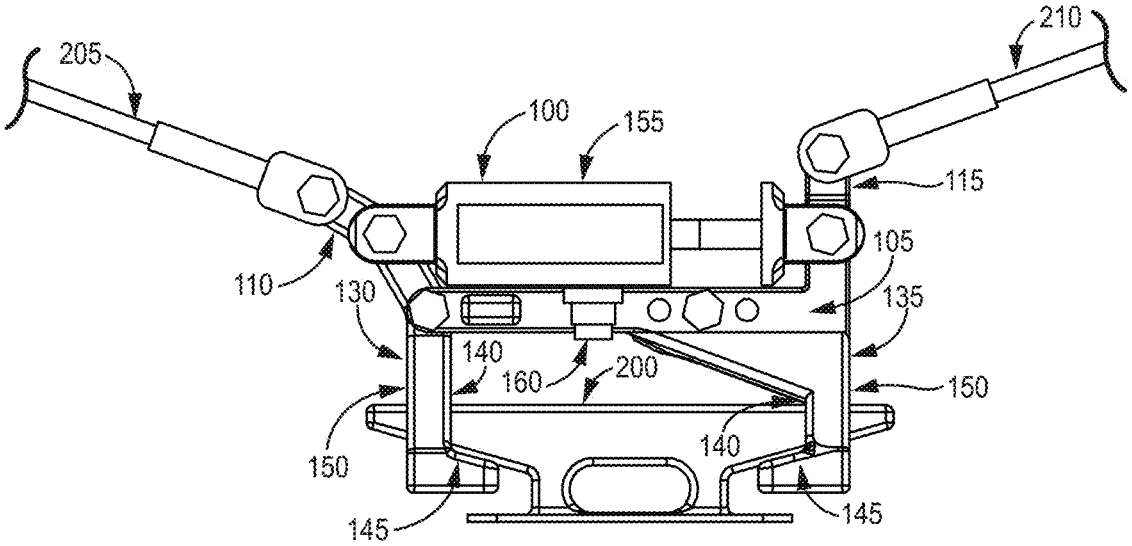

FIGS. 2A-2C show a sequence of attaching the vessel attachment device 100 to a vessel attachment point 200. In this illustrated example, the vessel attachment point 200 is in the form of a kevel, for instance as may be included on a vessel in the form of a barge. However, the vessel attachment device 100 can be configured to attach to a variety of other types of vessel attachment points 200 in various applications.

FIG. 2A is a side elevational view of the vessel attachment device 100 approaching the vessel attachment point 200. As shown here, the line connection interface 110 can be configured to connect to a first line 205 and the line connection interface 115 can be configured to connect to a second line 210. Each of the first line 205 and the second line 210 can be secured at an opposite end to a line actuating device, such as a winch or other appropriate actuating device. By actuating the line actuating devices, the tension in the lines 205, 210 can be adjusted to thereby move the vessel attachment device 100 up, down, left, and right relative to the view shown in FIG. 2A.

As shown in FIG. 2A, when the vessel attachment device 100 approaches the vessel attachment point 200, the movable attachment arm 130 is biased to the open position as a result of the biasing force imparted by the biasing member 155 at the movable attachment arm 130. The line actuating devices can be actuated to adjust the positioning of the vessel attachment device 100 and, thereby, align the vessel attachment device 100 with the vessel attachment point 200. The vessel attachment device 100 can be aligned with the vessel attachment point 200, for instance, when the vessel attachment point 200 is inside of at least one of the first and second attachment arms 130, 135 (e.g., between the first and second attachment arms 130, 135). In the illustrated embodiment, aligning the vessel attachment device 100 with the vessel attachment point 200 can include positioning the vessel attachment device 100 over the vessel attachment point 200 such that the vessel attachment point 200 is inside of at least one of the fixed second attachment arm 135 and then lowering the vessel attachment device 100 toward the vessel attachment point 200.

In some embodiments, the position feedback device 160 can be used to assist in aligning the vessel attachment device 100 with the vessel attachment point 200. For example, data transmitted by the position feedback device 160 can be used (e.g., by an operator or in an automated manner) to determine particular actuation inputs at the line actuating devices to correspondingly adjust the tension in the lines 205, 210 and, thereby, adjust the positioning of the vessel attachment device 100.

FIG. 2B is a side elevational view of the vessel attachment device 100 positioned at, and attaching to, the vessel attachment point 200. As shown in the illustrated embodiment, a portion of the vessel attachment point 200 is retained at the holding structure 150 of the second (e.g., fixed relative to the body 105) attachment arm 135. As noted previously, the holding structure 150 can define a retention structure complementary to the retained portion of the vessel attachment point 200. As the vessel attachment device 100 is aligned with the vessel attachment point 200, a portion of the vessel attachment point 200 can pass over the contact surface 145 of the second attachment arm 135. And, after this portion of the vessel attachment point 200 has passed over the contact surface 145 of the second attachment arm 135, the holding structure 150 of the second attachment arm 135 can engage and retain that portion of the vessel attachment point 200 at the holding structure 150 of the second attachment arm 135.

Again, in some embodiments, the position feedback device 160 can be used to assist in appropriately positioning the vessel attachment device 100 such that the second attachment arm 135 engages the vessel attachment point 200. For example, data transmitted by the position feedback device 160 can be used (e.g., by an operator or in an automated manner) to determine particular actuation inputs at the line actuating devices to correspondingly adjust the tension in the lines 205, 210 and, thereby, bring the contact surface 145 and holding structure 150 of the second attachment arm 135 into sufficient engagement with the portion of the vessel attachment point 200.

Figure 3:
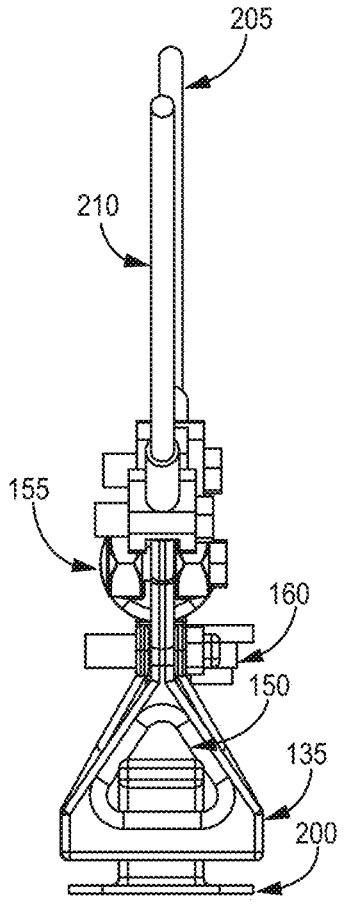
FIG. 3 is a side end elevational view of the vessel attachment device removably attached to the vessel attachment point, as in FIG. 2C.

FIG. 2C is a side elevational view of the vessel attachment device 100 attached to the vessel attachment point 200. And, FIG. 3 is a side end elevational view of the vessel attachment device 100 attached to the vessel attachment point 200, as in FIG. 2C.

In addition to engaging the second attachment arm 135 at the vessel attachment point 200 (e.g., in FIG. 2B), the vessel attachment device 100 is attached to the vessel attachment point 200 by engaging the first, movable attachment arm 130 at the vessel attachment point 200. In particular, to attach the vessel attachment device 100 to the vessel attachment point 200, the first, movable attachment arm 130 is moved from the open position to the closed position. To move the first attachment arm 130 from the open position to the closed position, the biasing force applied by the biasing member 155 on the first attachment arm 130 is overcome.

The biasing force on the first attachment arm 130 can be overcome by applying an actuation force at the line connection interface 110, causing the first attachment arm 130 to move to the closed position. In the illustrated example, the actuation force can be applied at the line connection interface 110 via the line 205. In particular, the line actuation device secured to the line 205 can be actuated to adjust the tension in the line 205 to thereby correspondingly apply an actuation force at the line connection interface 110. For instance, the tension in the line 205 can be increased by actuating the line actuation device which in turn can apply an actuation force at the line connection interface 110 sufficient to overcome the biasing force on the first attachment arm 130 and thereby cause the first attachment arm 130 to move from the open position to the closed position. When the first attachment arm 130 is moved to the closed position, as shown in FIGS. 2C and 3, the contact surface 145 and holding structure 150 of the first attachment arm 130 are brought into sufficient engagement with the portion of the vessel attachment point 200. This acts to retain the portion of the vessel attachment point 200 at the vessel attachment point interface portion 140 of the first attachment arm 130.

Similarly, the vessel attachment device 100 can be removed from the vessel attachment point 200 by adjusting the actuation force applied at the line connection interface 110. In particular, in the illustrated embodiment, the line actuation device secured to the line 205 can be actuated to adjust the tension in the line 205 to thereby correspondingly adjust an actuation force at the line connection interface 110. For instance, the tension in the line 205 can be decreased by actuating the line actuation device which in turn can reduce the actuation force at the line connection interface 110 to a level sufficient to allow the biasing force applied by the biasing member 155 on the first attachment arm 130 to move first attachment arm 130 from the closed position (e.g., shown in FIGS. 2C and 3) to the open position (e.g., shown in FIGS. 2A and 2B). When the first attachment arm 130 is moved to the open position, the portion of the vessel attachment point 200 can move out from the holding structure 150 and move down the sloped contact surface 145 of the first attachment arm 130 so as to be released from the first attachment arm 135. The line actuating devices can then be actuated to further adjust the tension in the lines 205 and/or 210 to thereby move, and release, the portion of the vessel attachment point 200 out from the second attachment arm 135 of the vessel attachment device 100.

Thus, the vessel attachment device 100 can be useful in attaching to, and removing from, the vessel attachment point 200 without the need for human input at the vessel attachment device 100 to vessel attachment point 200 attachment location. Rather, the vessel attachment device 100 can be moved into alignment with, attached to, and removed from the vessel attachment point 200 via human input at a location remote from the attachment location (e.g., at a remote control location). In this way, the vessel attachment device 100 does not necessitate any manual human input at the vessel attachment point 200 and can thereby eliminate the need to have a human presence on the vessel. This, in turn, can increase the safety and efficiency of a variety of vessel-related operations across many different applications.

Figure 4:
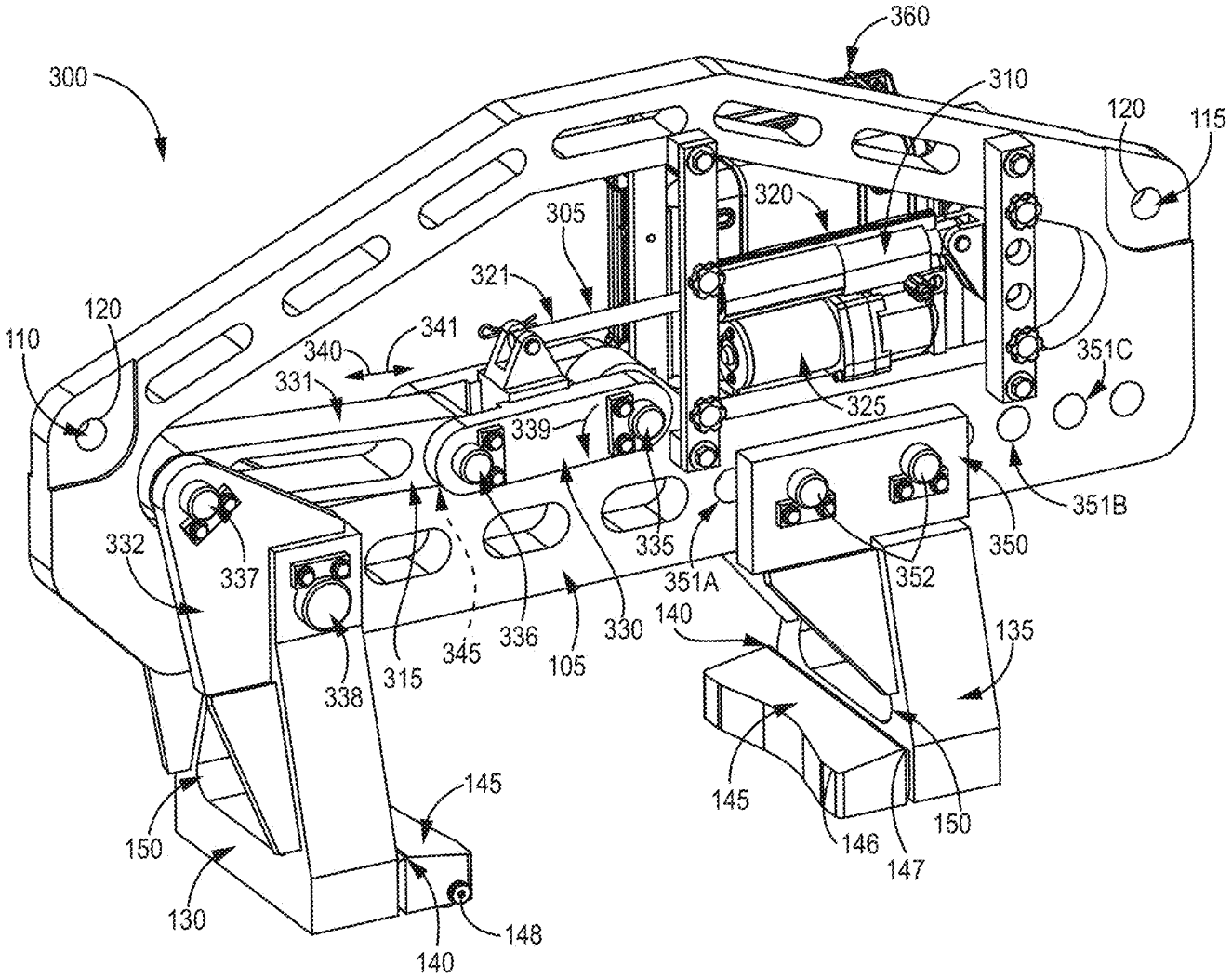
FIG. 4 is a perspective view of another embodiment of a vessel attachment device.
Figure 5A:
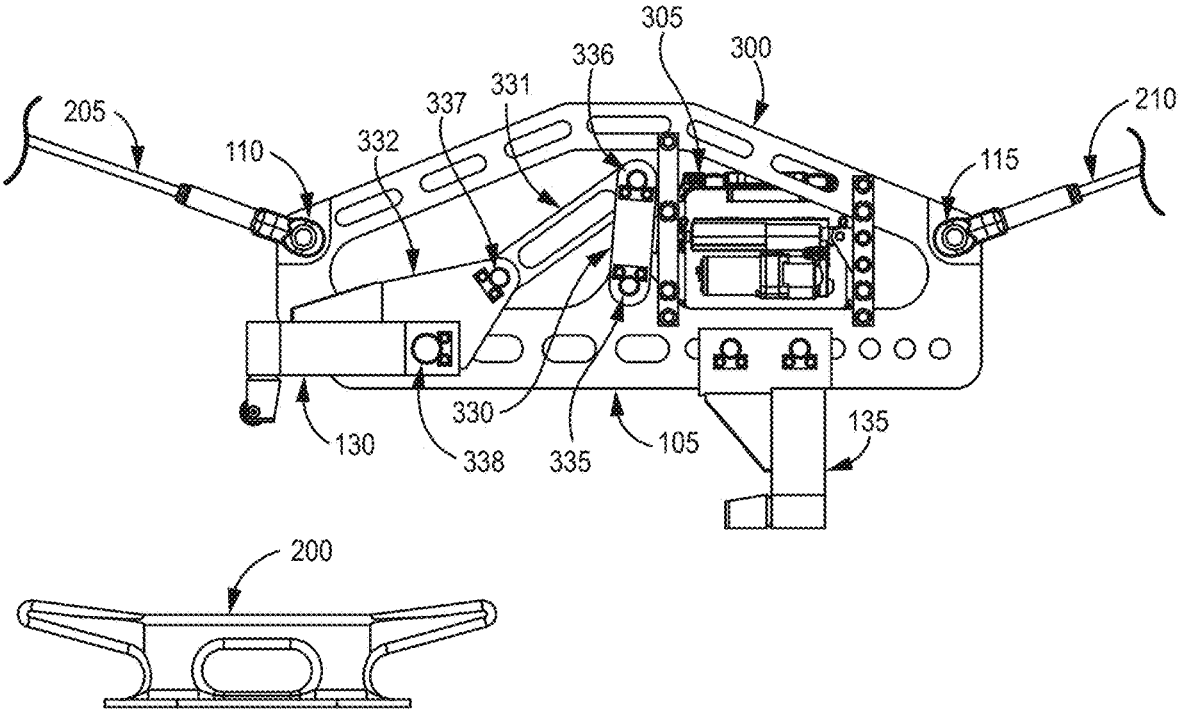
FIGS. 5A-5C show a sequence of attaching the vessel attachment device, of FIG. 4, to a vessel attachment point.
Figure 5B:
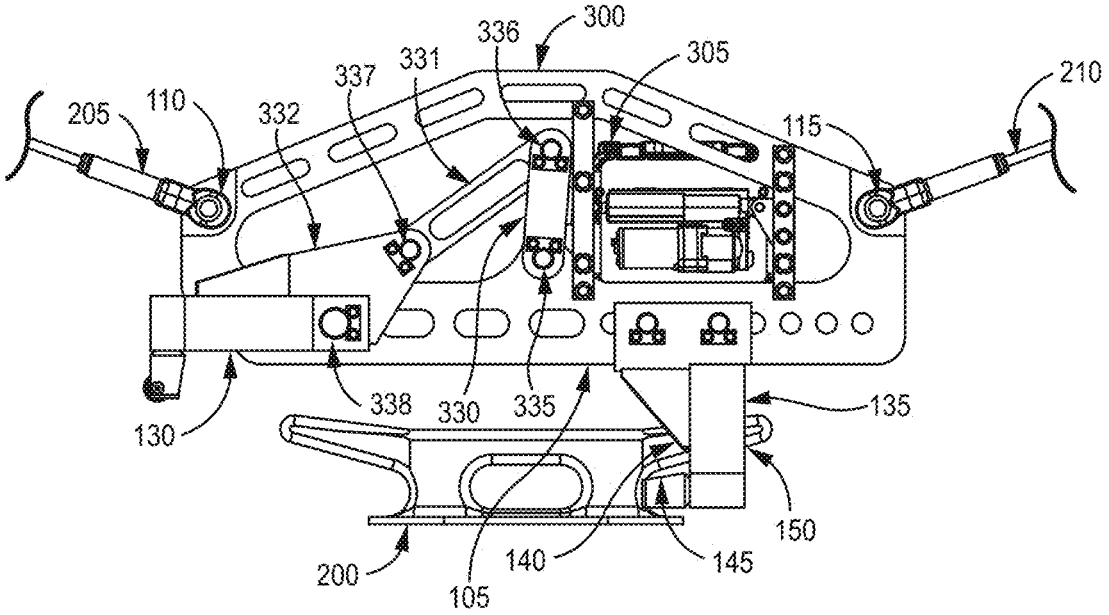
Figure 5C:
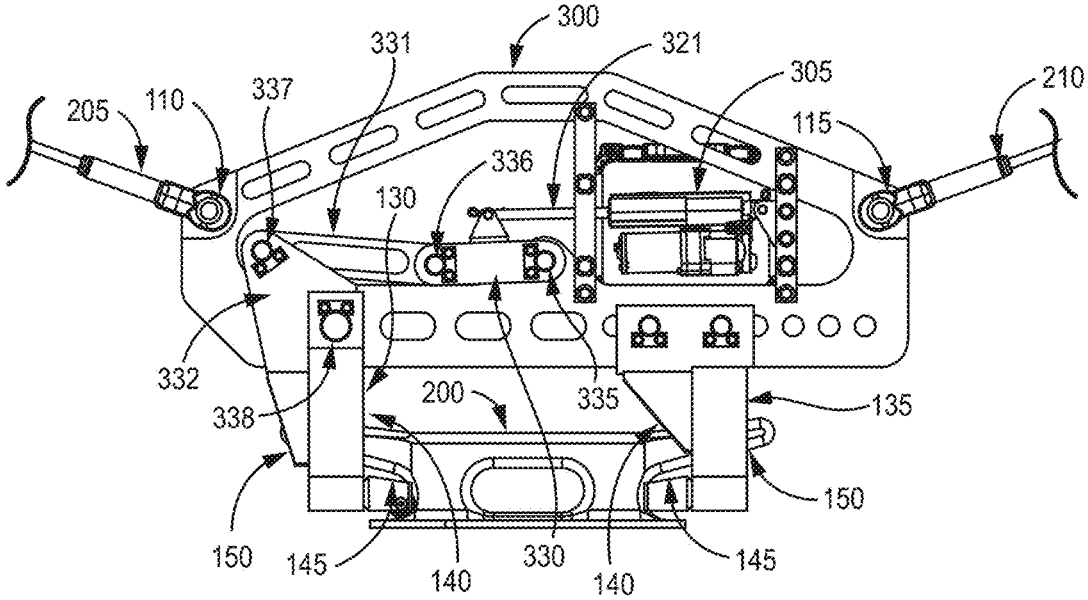
Figure 6:
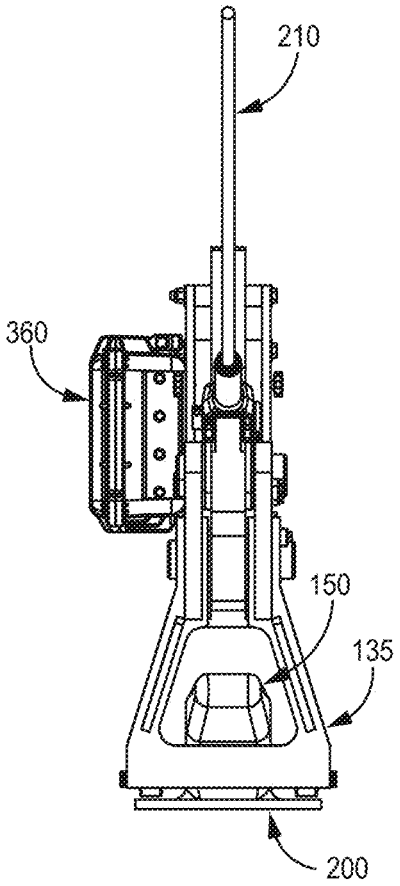
FIG. 6 is a side end elevational view of the vessel attachment device, of FIG. 4, removably attached to the vessel attachment point, as in FIG. 5C.

FIGS. 4-6 illustrate another embodiment of a vessel attachment device 300. The vessel attachment device 300 is similar to the vessel attachment device 100 described previously herein, but the vessel attachment device 300 includes a modified biasing member, as will be described. Like reference character numerals indicate like elements, and features and functions of the vessel attachment device 300 can be the same as, or similar to, those corresponding features and functions of the vessel attachment device 100 except as described below.

FIG. 4 is a perspective view of an exemplary embodiment of a vessel attachment device 300. Like the vessel attachment device 100, in operation, the vessel attachment device 300 can selectively attach a line to a vessel and remove the line from the vessel. The vessel attachment device 300 can be configured to both attach the line to, and remove the line from, the vessel without requiring human presence at the vessel. As such, the vessel attachment device 300 can both selectively attach to and selectively release from a vessel in an automated manner that eliminates the need to have a human present at the vessel to manually attach the line to the vessel.

The illustrated vessel attachment device 300 includes the body 105 and the line connection interfaces 110, 115 configured to connect to one or more lines. For example, the line connection interface 110 can be configured to connect to a first line and the line connection interface 115 can be configured to connect to a second line. Each line connection interface 110, 115 can include the connection member 120 that is complementary to a connection member at the respective line in a manner that is configured to interconnect to respective line and line connection interface 110, 115.

The vessel attachment device 300 also includes the first attachment arm 130 and the second attachment arm 135. Each of the first attachment arm 130 and the second attachment arm 135 extends out from the body 105. As will be described further below, at least one of the first attachment arm 130 and the second attachment arm 135 is movable relative to the body 105. In the illustrated embodiment of the vessel attachment device 300, the first attachment arm 130 is movable relative to the body 105 and the second attachment arm 135 is fixed relative to the body 105. Though in other vessel attachment device embodiments, both the first attachment arm 130 and the second attachment arm 135 can be movable relative to the body 105.

Each of the first attachment arm 130 and the second attachment arm 135 can be configured to contact, and attach to, a vessel attachment point. For example, each attachment arm 130, 135 can include the vessel attachment point interface portion 140 that is configured to contact, and attach to, the vessel attachment point. For example, each illustrated interface portion 140 includes the contact surface 145 and the holding structure 150, as described previously. In one embodiment (e.g., of the vessel attachment device 300 and/or 100), the vessel attachment point interface portion 140 can include one or more roller elements, such as at location 148 (e.g., a surface opposite the contact surface 145). The one or more roller elements can be positioned at the vessel attachment point interface portion 140 so as to contact the deck surface at which the vessel attachment point is located and act to reduce friction and facilitate movement of the respective attachment arm 130, 135 along the deck surface as the respective attachment arm 130, 135 is moved along the deck surface into attachment with the vessel attachment point. The one or more roller elements can rotate, relative to the respective attachment arm 130, 135, as the respective attachment arm 130, 135 is moved along the deck surface into attachment with the vessel attachment point, thereby can reduce interference at this contact interface and provide a smoother attachment operation.

The vessel attachment device 300 further includes a biasing member 305. The biasing member 305 can be configured to apply a biasing force on at least one of the first attachment arm 130 and the second attachment arm 135. For example, the biasing member 305 can be configured to apply the biasing force on the at least one movable first attachment arm and second attachment arm 130, 135 to bias the at least one movable first attachment arm and second attachment arm 130, 135 to an open position. The open position can be configured to allow the vessel attachment point to be received at the vessel attachment device 300 (e.g., the attachment arms 130, 135 are further apart from each other in the open position than in the closed position). In the illustrated embodiment, the first attachment arm 130 is movable between open and closed positions, so the biasing member 305 is configured to apply the biasing force on the movable first attachment arm 130 to bias the moveable attachment arm 130 to the open position. In the open position, the movable attachment arm 130 can be further from the second attachment arm 135 than in the closed position.

The biasing member 305 is further configured to selectively release the biasing force and apply an actuation force at the at least one movable first attachment arm and second attachment arm 130, 135 to move the at least one movable first attachment arm and second attachment arm 130, 135 from the open position to a closed position to attach the vessel attachment device 300 to a vessel attachment point. The closed position can be configured to attach the vessel attachment point to the vessel attachment device 300, for instance at the first attachment arm 130 and the second attachment arm 135. Here, in the closed position, the first and second attachment arms 130, 135 are closer together than in the open position. Again, in the illustrated embodiment, the first attachment arm 130 is movable between open and closed positions. So, the biasing member 305 is configured to selectively release the biasing force on the first attachment arm 130 and apply an actuation force at the first attachment arm 130 to move the first attachment arm 130 from the open position to the closed position to attach the vessel attachment device 300 to a vessel attachment point.

In the illustrated embodiment, the biasing member 305 includes an actuator 310 and a force transfer mechanism 315. The actuator 310 can be configured to generate and provide the biasing force and the actuation force. The force transfer mechanism 315 can couple the actuator 310 to the at least one movable first attachment arm and second attachment arm 130, 135. In the illustrated embodiment, where the first attachment arm 130 is movable, the force transfer mechanism 315 couples the actuator 310 to the first attachment arm 130 such that the actuator 310 generates and provides the biasing force on the first attachment arm 130, via the force transfer mechanism 315, to maintain the first attachment arm 130 at the open position. Likewise, in the illustrated embodiment, the force transfer mechanism 315 couples the actuator 310 to the first attachment arm 130 such that the actuator 310 generates and provides the actuation force on the first attachment arm 130, via the force transfer mechanism 315, to bring and maintain the first attachment arm 130 at the closed position.

The actuator 310 can include one or more components for selectively providing the biasing force and actuation force. As one example, the actuator 310 can include a drive component 320 and a force generation component 325. The drive component 320 can be connected to the force transfer mechanism 315 and the force generation component 325. For instance, the drive component 320 can include a drive shaft 321 connected to the force transfer mechanism 315 at one end and connected to the force generation component 325 at another, opposite end. The force generation component 325 can be configured to generate force for selectively moving the drive component 320 (e.g., the drive shaft 321). In the illustrated embodiment, the actuator 310 can be a linear actuator, with an electric motor as part of the drive component 320 for linearly moving the drive shaft 321 and a pressurizing pump (e.g., hydraulic pump) as part of the force generation component 325.

In the embodiment shown here, the force transfer mechanism 315 includes a linkage assembly. In various embodiments, the linkage assembly can include two or more link elements. In the embodiment shown here, the linkage assembly includes a first link element 330, a second link element 331, and a third link element 332. The first link element 330 is connected to the actuator 310, via connection point 334 (e.g., connected to the drive shaft 321 at connection point 334), and connected to the second link element 331, via connection point 336, at another (e.g., opposite) end. The first link element 330 is also connected to the body 105, via connection point 335 about which the first link element 330 rotates relative to the body 105. The second link element 331 is connected to the first link element 330 at one end, via connection point 336, and connected to the third link element 332, via connection point 337, at another (e.g., opposite) end. The third link element 332 is connected to the second link element 331 at one end, via the connection point 337, and connected to the first attachment arm 130 at another (e.g., opposite) end, via the connection point 338.

The linkage assembly of the force transfer mechanism 315 can act to transfer force received from the actuator 310 to the first attachment arm 130 as suited for moving the first attachment arm 130 between the open and closed positions as well as maintaining the first attachment arm 130 at the open and/or closed positions. For example, in instances where the actuator 310 provides force in a linear manner (e.g., via the drive shaft 321), the linkage assembly can act to transfer that linear force from the actuator 310 into rotational movement of the first attachment arm 130. Also, to provide the biasing force on the first attachment arm 130 to maintain the first attachment arm 130 in the open position, the linkage assembly can act to transfer the linear force from the actuator into linear force on the first attachment arm 130.

In operation of the illustrated example (e.g., as seen best in the sequence shown in FIGS. 5A-5C), when force is applied by the actuator 310, the first link element 330 can be configured to rotate about the connection point 335, via which the first link element 330 is connected to the body 105. This rotational movement of the first link element 330 about the connection point 335 can cause the second link element 331 to move toward (e.g., in the direction 340), or away (e.g., in the direction 341) from, the first attachment arm 130. For example, when the first link element 330 is rotated about the connection point 335 in a counterclockwise direction 339 the second link element 331 is moved toward the first attachment arm 130, and when the first link element 330 is rotated about the connection point 335 in a clockwise direction (opposite the counterclockwise direction 339) the second link element 331 is moved away the first attachment arm 130. When the second link element 331 is moved toward the first attachment arm 130, it causes the third link element 332 to rotate about both the connection points 337, 338 and move the first attachment arm 130 toward the closed position (e.g., toward the second attachment arm 135). When the second link element 331 is moved away the first attachment arm 130, it causes the third link element 332 to rotate about both the connection points 337, 338 and move the first attachment arm 130 toward the open position (e.g., away from the second attachment arm 135).

FIG. 4 shows the first attachment arm 130 in the closed position. In some embodiments, when the attachment device 300 is in the closed position, the first link element 330 can be at an over-centered position, for instance as shown in FIG. 4. For example, in the over-centered position, the first link element 330 can extend out, from the connection point 335 in a direction toward the second link element 331, at an angle toward the first attachment arm 130 such that the first link element 330 slopes downward, in a direction from the connection point 335 toward to second link element 331, toward the first attachment arm 130. The over-centered position of the first link element 330 can be configured to maintain the movable first attachment arm 130 in the closed position. For example, the over-centered position of the first link element 330 can be configured such that, for the movable first attachment arm 130 to move from the closed position to the open position, the actuator 310 needs to apply a second actuation force (e.g., to cause the second link element 331 to move away (e.g., in the direction 341) from the first attachment arm 130). The over-centered position of the first link element 330 can be oriented such that forces imparted on the first link element 330, from vessel attachment device components other than the actuator 310, are transferred through the first link element 330 without causing rotational movement of the first link element 330. In this way, the over-centered position of the first link element 330 can be configured to resist rotational movement of the first link element 330, upon application of force from vessel attachment device components other than the actuator 310, and thereby maintain the movable first attachment arm 130 in the closed position. This can be useful in reducing a risk that the vessel attachment device 300 inadvertently transitions out of the closed position during use.

In various embodiments, the vessel attachment device 300 can include one or more additional features. For example, the vessel attachment device 300 can include a lock feedback mechanism 345. The lock feedback mechanism 345 can be configured to cause a signal to be generated when the force transfer mechanism 315 is in a locked position at which the movable first attachment arm 130 is locked in the closed position. For example, the lock feedback mechanism 345 can be configured to cause the signal to be generated when the force transfer mechanism 315 is in a locked position by determining when the first link element 330 is in the over-centered position. In one such embodiment, the lock feedback mechanism 345 can be a switch that is activated to cause the signal to be generated when the first link element 330 or second link element 331 contacts the body 105. In this embodiment, the switch could be located on the body 105 so as to be activated when contacted by the first link element 330 or second link element 331. The signal generated by the lock feedback mechanism 345 can cause an output mechanism, such as a visible and/or audible indication, at the vessel attachment device 300 to be activated and/or can cause a signal to be sent from the vessel attachment device 300 to a remote receiving device.

The illustrated vessel attachment device 300 also includes an arm adjustment mechanism 350. The arm adjustment mechanism 350 can be configured to adjust the spacing between the first and second attachment arms 130, 135, in turn allowing the vessel attachment device 300 to be adjusted to attach to various sized vessel attachment points. In the illustrated embodiment, the arm adjustment mechanism 350 is configured to adjust the lateral positioning of the second attachment arm 135 (e.g., the arm that does not move between open and closed positions). The arm adjustment mechanism 350 includes multiple apertures 351A, 351B, 351C and one or more arm securement members 352. The apertures 351A, 351B, 351C are spaced laterally from one another along the body 105 and each is configured to removably receive an arm securement member 352. Each arm securement members 352 can be removably coupled to one aperture 351A, 351B, 351C to thereby secure the second attachment arm 135 to the body 105. In the example shown, two arm securement members 352 are included, with each of the two arm securement members 352 coupled to a respective aperture. The arm securement members 352 can be coupled to select apertures to determine the spacing between the first and second attachment arms 130, 135. When needed, the arm securement members 352 can be removed from the select apertures, so as to allow the second attachment arm 135 to be moved laterally relative to the first attachment arm 130, and removably coupled to different select apertures to adjust the spacing between the first and second attachment arms 130, 135.

In one embodiment including the arm adjustment mechanism 150, the lateral adjustment to the position of the second attachment arm 135 can be performed in an automated manner. In such an embodiment, the arm adjustment mechanism 150 can include an arm adjustment actuator coupled to both the second attachment arm 135 and the one or more arm securement members 352. The arm adjustment actuator can supply a force to remove the one or more arm securement members 352 from the respective aperture(s), then supply a force to laterally move the second attachment arm 135 relative to the body 105 so as to align with one or more different aperture(s), and then supply a force to couple the one or more arm securement members 352 to the one or more different respective aperture(s). Thus, while in some embodiments the second attachment arm 135 may not move from open to closed positions, the second attachment arm 135 may move laterally (e.g., non-rotationally) relative to the body 105.

In some embodiments, the vessel attachment device 300 can include a transceiver 360 for remote communication to and/or from the vessel attachment device 300. For example, the transceiver 360 can be in communication with actuator 310. As such, the transceiver 360 can receive a close command signal from a remote communication device and, as a result, cause the vessel attachment device 300 to apply the actuation force on the first attachment arm 130, via the actuator 310, to move the first attachment arm 130 from the open position to the closed position. Likewise, the transceiver 360 can receive an open command signal from a remote communication device and, as a result, cause the vessel attachment device 300 to apply the second actuation force on the first attachment arm 130, via the actuator 310, to move the first attachment arm 130 from the closed position to the open position and apply a bias force on the first attachment arm 130 to maintain the first attachment arm 130 in the open position. As another example, the transceiver 360 can be in communication with the lock feedback mechanism 345, when included. As such, when lock feedback mechanism 345 causes a signal to be generated when the force transfer mechanism 315 is in a locked position, the transceiver can output a lock feedback signal from the vessel attachment device 300 to the remote communication device.

As described in reference to the vessel attachment device 100, the vessel attachment device 300 can include the position feedback device 160, power source, and/or one or more notification features as described elsewhere herein. When included, the position feedback device 160, power source, and/or one or more notification features of the vessel attachment device 300 can be as described previously with respect to the vessel attachment device 100. The position feedback device 160 can be in communication with the transceiver 360 so as to relay information relating to the position of the vessel attachment device 100 relative to the vessel attachment point.

FIGS. 5A-5C show a sequence of attaching the vessel attachment device 300 to the vessel attachment point 200.

FIG. 5A is a side elevational view of the vessel attachment device 300 approaching the vessel attachment point 200. As shown here, the line connection interface 110 can be configured to connect to the first line 205 and the line connection interface 115 can be configured to connect to the second line 210. As described previously, each of the first line 205 and the second line 210 can be secured at an opposite end to a line actuating device, such as a winch or other appropriate actuating device. By actuating the line actuating devices, the tension in the lines 205, 210 can be adjusted to thereby move the vessel attachment device 300 up, down, left, and right relative to the view shown in FIG. 5A.

As shown in FIG. 5A, when the vessel attachment device 300 approaches the vessel attachment point 200, the movable attachment arm 130 is biased to the open position as a result of the biasing force imparted by the biasing member 305 at the movable attachment arm 130. The line actuating devices can be actuated to adjust the positioning of the vessel attachment device 300 and, thereby, align the vessel attachment device 300 with the vessel attachment point 200. In the illustrated embodiment, aligning the vessel attachment device 300 with the vessel attachment point 200 can include positioning the vessel attachment device 300 over the vessel attachment point 200 such that the vessel attachment point 200 is inside of at least the fixed second attachment arm 135 and then lowering the vessel attachment device 300 toward the vessel attachment point 200.

FIG. 5B is a side elevational view of the vessel attachment device 300 positioned at, and attaching to, the vessel attachment point 200. As shown in the illustrated embodiment, a portion of the vessel attachment point 200 is retained at the holding structure 150 of the second (e.g., fixed relative to the body 105) attachment arm 135. As noted previously, the holding structure 150 can define a retention structure complementary to the retained portion of the vessel attachment point 200. As the vessel attachment device 200 is aligned with the vessel attachment point 200, a portion of the vessel attachment point 200 can pass over the contact surface 145 of the second attachment arm 135. And, after this portion of the vessel attachment point 200 has passed over the contact surface 145 of the second attachment arm 135, the holding structure 150 of the second attachment arm 135 can engage and retain that portion of the vessel attachment point 200 at the holding structure 150 of the second attachment arm 135.

As shown in FIGS. 5A and 5B, the first attachment arm 130 is in the open position and a bias force is provided by the basing member 305 to maintain the first attachment arm 130 in the open position. In the illustrated open position, the first link element 330 extends generally vertically between the connection point 335 and the connection point 336, and the second link element 331 extends at an angle of about forty five degrees between the connection point 336 and the connection point 337. The third link element 332 is positioned toward the biasing member 305 at the connection point 337, resulting in the first attachment arm 130 being at the open position away from the second attachment arm 135.

FIG. 5C is a side elevational view of the vessel attachment device 300 attached to the vessel attachment point 200. And, FIG. 6 is a side end elevational view of the vessel attachment device 300 attached to the vessel attachment point 200, as in FIG. 5C.

In addition to engaging the second attachment arm 135 at the vessel attachment point 200 (e.g., in FIG. 5B), the vessel attachment device 300 is attached to the vessel attachment point 200 by engaging the first, movable attachment arm 130 at the vessel attachment point 200. In particular, to attach the vessel attachment device 300 to the vessel attachment point 200, the first, movable attachment arm 130 is moved from the open position to the closed position.

To move the first attachment arm 130 from the open position to the closed position, the biasing member 305 applies an actuation force on the first attachment arm 130. Namely, in the illustrated embodiment, the actuator 310 applies the actuation force on the first attachment arm 130 to move the first attachment arm 130 from the open position to the closed position. When the actuation force is applied by the actuator 310, the drive shaft 321 extends linearly causing the first link element 330 to rotate, in this example counterclockwise, about the connection point 335 from the generally vertical position, shown in FIGS. 5A and 5B, to the over-centered position shown in FIG. 5C. This rotational movement of the first link element 330 about the connection point 335 causes the second link element 331 to move toward the first attachment arm 130. When the second link element 331 is moved toward the first attachment arm 130, it causes the third link element 332 to rotate about both the connection points 337, 338 and rotate the first attachment arm 130 to the closed position. When the first attachment arm 130 is moved to the closed position, as shown in FIGS. 5C and 6, the contact surface 145 and holding structure 150 of the first attachment arm 130 are brought into sufficient engagement with the portion of the vessel attachment point 200. This acts to retain the portion of the vessel attachment point 200 at the vessel attachment point interface portion 140 of the first attachment arm 130.

Similarly, the vessel attachment device 300 can be removed from the vessel attachment point 200 when the biasing member 305 applies a second actuation force on the first attachment arm 130. Namely, in the illustrated embodiment, the actuator 310 applies the second actuation force on the first attachment arm 130 to move the first attachment arm 130 from the closed position to the open position. When the second actuation force is applied by the actuator 310, the drive shaft 321 retracts linearly causing the first link element 330 to rotate, in this example clockwise, about the connection point 335 from the over-centered position, shown in FIG. 5C, to the generally vertical position, shown in FIGS. 5A and 5B. This rotational movement of the first link element 330 about the connection point 335 causes the second link element 331 to move away the first attachment arm 130. When the second link element 331 is moved away the first attachment arm 130, it causes the third link element 332 to rotate about both the connection points 337, 338 and rotate the first attachment arm 130 to the open position. When the first attachment arm 130 is moved to the open position, the portion of the vessel attachment point 200 can move out from the holding structure 150 and move down the sloped contact surface 145 of the first attachment arm 130 so as to be released from the first attachment arm 135. The line actuating devices can then be actuated to further adjust the tension in the lines 205 and/or 210 to thereby move, and release, the portion of the vessel attachment point 200 out from the second attachment arm 135 of the vessel attachment device 100.

Thus, the vessel attachment device 300, like the vessel attachment device 100, can be useful in attaching to, and removing from, the vessel attachment point 200 without the need for human input at the vessel attachment device 300 to vessel attachment point 200 attachment location. Rather, the vessel attachment device 300 can be moved into alignment with, attached to, and removed from the vessel attachment point 200 via human input at a location remote from the attachment location (e.g., at a remote control location). In this way, the vessel attachment device 300 does not necessitate any manual human input at the vessel attachment point 200 and can thereby eliminate the need to have a human presence on the vessel. This, in turn, can increase the safety and efficiency of a variety of vessel-related operations across many different applications.

Figure 7:
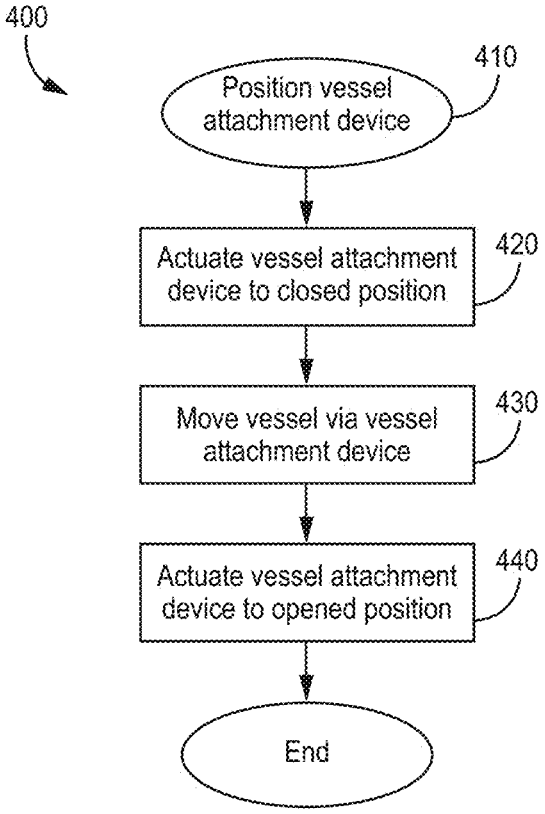
FIG. 7 is a flow diagram of an embodiment of a method of attaching a vessel attachment device to a vessel and moving the vessel via the vessel attachment device.

FIG. 7 is a flow diagram of an embodiment of a method 400 of attaching a vessel attachment device to a vessel and moving the vessel via the vessel attachment device. The vessel attachment device referenced with respect to the method 400 can be similar to, or the same as, the vessel attachment device embodiments disclosed elsewhere herein. For example, the vessel attachment device referenced with respect to the method 400 can be the vessel attachment device 100 or the vessel attachment device 300.

At step 410, the method 400 incudes positioning the vessel attachment device. The vessel attachment device can be positioned relative to the vessel attachment point to which the vessel attachment device is to attach. The vessel attachment device can be positioned relative to the vessel attachment point while at least one attachment arm of the vessel attachment device is in an open position as a result of a biasing force imparted on the attachment arm by a biasing member of the vessel attachment device. The vessel attachment device can be positioned, for instance, such that the vessel attachment point is inside of at least one attachment arm of the vessel attachment device. This could include positioning a portion of the vessel attachment point within a holding structure of such attachment arm. The vessel attachment device can be positioned relative to the vessel attachment point by adjusting the tension in one or more lines connected to one or more line connection interfaces at the vessel attachment device. Notably, step 410 can take place without the need for human presence and input at the vessel attachment device to vessel attachment point attachment location.

At step 420, the method 400 includes actuating the vessel attachment device to a closed position. Actuating the vessel attachment device to the closed position can include moving at least one attachment arm of the vessel attachment device from an open position to a closed position.

In one example, the at least one attachment arm can be moved to the closed position, at step 420, by applying an actuation force at a line connection interface on the vessel attachment device, causing the at least one attachment arm to move to the closed position. For example, the actuation force can be applied at the line connection interface via a line connected thereat, such as by actuating a line actuation device secured to the line can be actuated to thereby cause the tension in the line to be adjusted and correspondingly apply an actuation force at the line connection interface. In one such instance, the tension in the line can be increased by actuating the line actuation device which in turn can apply the actuation force at the line connection interface that is sufficient to overcome the biasing force on the at least one attachment arm and thereby cause this attachment arm to move from the open position to the closed position.

In another example, the at least one attachment arm can be moved to the closed position, at step 420, by applying an actuation force via an actuator at the at least one attachment arm to move the at least one attachment arm to the closed position. For example, the actuator can apply the actuation force at the at least one attachment arm via a force transfer mechanism, such as multiple link elements. In this example, when the at least one attachment arm is moved to the closed position, a link element of the force transfer mechanism can be transitioned to an over-centered position that locks the at least one attachment arm at the closed position.

When the attachment arm is moved to the closed position, at step 420, a contact surface and holding structure of the attachment arm can be brought into sufficient engagement with the portion of the vessel attachment point so as to retain the portion of the vessel attachment point at the attachment arm. Notably, step 420 can take place without the need for human presence and input at the vessel attachment device to vessel attachment point attachment location.

At step 430, the method 400 includes moving the vessel via the vessel attachment device. Step 430 can take place after the vessel attachment device is attached to the vessel attachment point at step 420. Moving the vessel via the vessel attachment device at step 430 can include actuating one or more line actuation devices secured to one or more respective lines connected at the vessel attachment device. Actuating the one or more line actuation devices can transfer a force along the respective line to the vessel attachment device which in turn can transfer this force to the vessel attachment point to cause the vessel to move in a corresponding direction. Notably, step 430 can take place without the need for human presence and input at the vessel attachment device to vessel attachment point attachment location.

At step 440, the method 400 includes actuating the vessel attachment device to the open position. For example, after the vessel has been moved to the desired position, at step 440 the at least one movable attachment arm can be moved from the closed position to the open position to allow the vessel attachment device to be removed from the vessel attachment point.

In one example, at step 440, the at least one movable attachment arm can be moved from the closed position to the open position by adjusting the actuation force applied at the line connection interface of the vessel attachment device. This can be accomplished by actuating the line actuation device secured to the line connected to the line connection interface to thereby adjust the tension in the line and correspondingly adjust an actuation force at the line connection interface. For instance, the tension in the line can be decreased by actuating the line actuation device which in turn can reduce the actuation force at the line connection interface to a level sufficient to allow the biasing force applied by the biasing member on the at least one movable attachment arm to move this attachment arm from the closed position to the open position.

In another example, the at least one movable attachment arm can be moved from the closed position to the open position, at step 440, by applying a second actuation force via an actuator at the at least one attachment arm to move the at least one attachment arm to the open position. For example, the actuator can apply the second actuation force at the at least one attachment arm via the force transfer mechanism, such as multiple link elements. In this example, when the at least one attachment arm is moved to the open position, a link element of the force transfer mechanism can be initially transitioned from the over-centered position, which previously locked the at least one attachment arm at the closed position, to a more vertical position.

Moving the at least one movable attachment arm to the open position, at step 440, can release the portion of the vessel attachment point out from the holding structure of the attachment arm and thereby release the portion of the vessel attachment point from the attachment arm. Notably, step 440 can take place without the need for human presence and input at the vessel attachment device to vessel attachment point attachment location.

Various non-limiting exemplary embodiments have been described. It will be appreciated that suitable alternatives are possible without departing from the scope of the examples described herein.

What is claimed is:

1. A vessel attachment device comprising:

a body;

at least one line connection interface at the body;

a first attachment arm extending out from the body;

a second attachment arm extending out from the body, wherein at least one of the first attachment arm and the second attachment arm is movable relative to the body between an open position and a closed position; and a biasing member coupled to the at least one of the first attachment arm and the second attachment arm that is movable relative to the body, wherein the biasing member is configured to apply a biasing force at the at least one of the first attachment arm and the second attachment arm that is movable relative to the body to bias the at least one of the first attachment arm and the second attachment arm that is movable relative to the body to the open position, and wherein the biasing member is configured to selectively release the biasing force and apply an actuation force at the at least one of the first attachment arm and the second attachment arm that is movable relative to the body to move the at least one of the first attachment arm and the second attachment arm that is movable relative to the body from the open position to the closed position to attach the vessel attachment device to a vessel attachment point.

2. The device of claim 1, wherein the biasing member comprises:

an actuator configured to generate the biasing force and the actuation force; and a force transfer mechanism that couples the actuator to the at least one of the first attachment arm and the second attachment arm that is movable relative to the body.

3. The device of claim 2, wherein the force transfer mechanism comprises a linkage assembly, and wherein the linkage assembly comprises a first link element that is at an over-centered position when the at least one of the first attachment arm and the second attachment arm that is movable relative to the body is in the closed position.

4. The device of claim 3, wherein the over-centered position of the first link element is configured to maintain the at least one of the first attachment arm and the second attachment arm that is movable relative to the body in the closed position.

5. The device of claim 4, wherein the actuator is configured to apply a second actuation force at the at least one of the first attachment arm and the second attachment arm that is movable relative to the body to move the at least one of the first attachment arm and the second attachment arm that is movable relative to the body from the closed position to the open position.

6. The device of claim 5, wherein the over-centered position of the first link element is configured such that forces imparted on the first link element, other than from the actuator, are transferred through the first link element without causing rotational movement of the first link element.

7. The device of claim 4, wherein the first attachment arm is movable relative to the body, wherein the first link element is coupled to the body at a first connection point about which the first link element is configured to rotate, and wherein in the over-centered position the first link element slopes downward, toward the first attachment arm, in a direction from the first connection point toward the first attachment arm.

8. The device of claim 4, further comprising:

a local feedback mechanism at the body, wherein the local feedback mechanism is configured to cause a signal to be generated when the force transfer mechanism is in a locked position at which the at least one of the first attachment arm and the second attachment arm that is movable relative to the body is locked in the closed position, and wherein the force transfer mechanism is in the locked position when the first link element is in the over-centered position, and wherein in the over-centered position the first link element contacts the local feedback mechanism at the body to cause the signal to be generated.

9. The device of claim 1, wherein the first attachment arm and the second attachment arm are further apart from each other in the open position than in the closed position.

10. The device of claim 1, wherein the first attachment arm is movable relative to the body between the open and closed positions, and wherein the second attachment arm is fixed relative to the body.

11. The device of claim 1, wherein at least one of the first attachment arm and the second attachment arm comprises a vessel attachment point interface portion that comprises a contact surface and a holding structure, wherein the contact surface is configured to contact the vessel attachment point and slopes upward in a direction from an interior end portion of the contact surface opposite the holding structure toward an exterior end portion of the contact surface adjacent the holding structure, and wherein the holding structure defines a retention structure complementary to the vessel attachment point and configured to retain at least a portion of the vessel attachment point after the vessel attachment point has passed over the contact surface.

12. The device of claim 11, wherein the vessel attachment point interface portion further comprises one or more roller elements that are configured to rotate relative to at least one of the first attachment arm and the second attachment arm, and wherein the one or more roller elements are positioned at the vessel attachment point interface portion opposite the contact surface.

13. The device of claim 1, wherein the at least one line connection interface is configured to connect to a first line, and wherein the at least one line connection interface comprises a first connection member that is complementary to a second connection member at the first line so as to allow the at least one line connection interface to connect to the first line.

14. The device of claim 1, further comprising:

an arm adjustment mechanism configured to adjust a spacing between the first attachment arm and the second attachment arm, wherein the arm adjustment mechanism comprises multiple apertures, laterally spaced from one another along the body, and an arm securement member configured to be removably received at at least one of the multiple apertures to thereby secure one or the first attachment arm and the second attachment arm to the body at a lateral position of the at least one of the multiple apertures at which the arm securement member is received.

15. The device of claim 1, further comprising:

a transceiver at the body and in communication with the biasing member, wherein the transceiver is configured to receive a close command signal from a remote communication device and, as a result, cause the biasing member to release the biasing force and apply the actuation force at the at least one of the first attachment arm and the second attachment arm that is movable relative to the body to move the at least one of the first attachment arm and the second attachment arm that is movable relative to the body from the open position to the closed position.

16. The device of claim 15, further comprising:

a position feedback device in communication with the transceiver, wherein the position feedback device is configured to generate information relating to a position of the vessel attachment device relative to the vessel attachment point, and wherein the transceiver is configured to relay the information relating to the position of the vessel attachment device relative to the vessel attachment point to the remote communication device.

17. A method of using a vessel attachment device comprising the steps of:

positioning the vessel attachment device relative to a vessel attachment point of a vessel;

actuating the vessel attachment device to cause a first attachment arm of the vessel attachment device to move from an open position to a closed position, wherein in the closed position the first attachment arm engages the vessel attachment point;

after actuating the vessel attachment device to cause the first attachment arm to move to the closed position, moving the vessel via the vessel attachment device; and after moving the vessel via the vessel attachment device, actuating the vessel attachment device to cause the first attachment arm to move from the closed position to the open position.

18. The method of claim 17, further comprising the step of:

before actuating the vessel attachment device to cause the first attachment arm to move to the closed position, engaging the vessel attachment point with a second attachment arm of the vessel attachment device.

19. The method of claim 18, wherein the second attachment arm is fixed relative to a body of the vessel attachment device, and wherein positioning the vessel attachment device relative to the vessel attachment point comprises positioning the vessel attachment device over the vessel attachment point such that the vessel attachment point is inside of at least the fixed second attachment arm and then lowering the vessel attachment device toward the vessel attachment point.

20. The method of claim 17, wherein, as the first attachment arm is moved from the open position to the closed position, a portion of the vessel attachment point passes over a contact surface of the first attachment arm, and, after passing over the contact surface, the vessel attachment point is engaged with a holding structure of the first attachment arm, wherein the contact surface slopes upward in a direction from an interior end portion of the contact surface opposite the holding structure toward an exterior end portion of the contact surface adjacent the holding structure.

* * * * *